United States Patent [19]

Sutton et al.

[11] Patent Number: 4,582,966

[45] Date of Patent: Apr. 15, 1986

[54] TELE DISC GUARD

[76] Inventors: Bernard S. Sutton; George Spector, both of 233 Broadway, RM 3615, New York, N.Y. 10007

[21] Appl. No.: 555,559

[22] Filed: Nov. 28, 1983

[51] Int. Cl.[4] ..... H04R 1/12

[52] U.S. Cl. ..... 179/185

[58] Field of Search ..... 179/185, 184, 187, 178, 179/179

[56] References Cited

U.S. PATENT DOCUMENTS

| | | | |
|---|---|---|---|
| 2,188,958 | 2/1940 | Richardson et al. | 179/185 |
| 2,650,269 | 8/1953 | Webb | 179/185 |
| 3,243,527 | 3/1966 | Sternheim | 179/185 |
| 3,962,555 | 6/1976 | Efaw | 179/185 |

FOREIGN PATENT DOCUMENTS

| | | | |
|---|---|---|---|
| 325331 | 2/1930 | United Kingdom | 179/185 |
| 826993 | 11/1956 | United Kingdom | 179/185 |

*Primary Examiner*—Gene Z. Rubinson
*Assistant Examiner*—Danita R. Byrd

[57] ABSTRACT

A device for protecting a speaker and earpiece between a telephone handset from germs and the like is provided and consists of a flat frame member secured between a pair of receptacles that are shaped to cover the speaker and the earpiece when the frame member is clamped against the telephone handset. Each receptacle has a replaceable filter that will not interfere with normal functions of the telephone.

4 Claims, 8 Drawing Figures

TELE DISC GUARD

BACKGROUND OF THE INVENTION

The instant invention relates generally to telephones and more specifically it relates to a device for protecting a speaker and earpiece on a telephone handset from germs and the like.

When a person uses a telephone, especially a public telephone, they can transfer germs from their mouth to the speaker and from their ear to the earpiece. The next person to use the telephone can pick up these germs and get sick. To stop this transfer of germs is necessary so accordingly this situation is in need of an improvement.

SUMMARY OF THE INVENTION

A principle object of the present invention is to provide a device for protecting a speaker and earpiece on a telephone handset from germs and the like that can be made in any shape, contour, dimension and material necesary to fit all shapes and sizes of telephones.

Another object is to provide a device for protecting a speaker and earpiece on a telephone handset from germs and the like that is designed to be foldable to fit into a purse or pocket for easy concealment.

An additional object is to provide a device for protecting a speaker and earpiece on a telephone handset from germs and the like that will not interfere with normal functions of the telephone.

A further object is to provide a device for protecting a speaker and earpiece on a telephone handset from germs and the like that is simple and easy to use.

A still further object is to provide a device for protecting a speaker and earpiece on a telephone handset from germs and the like that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
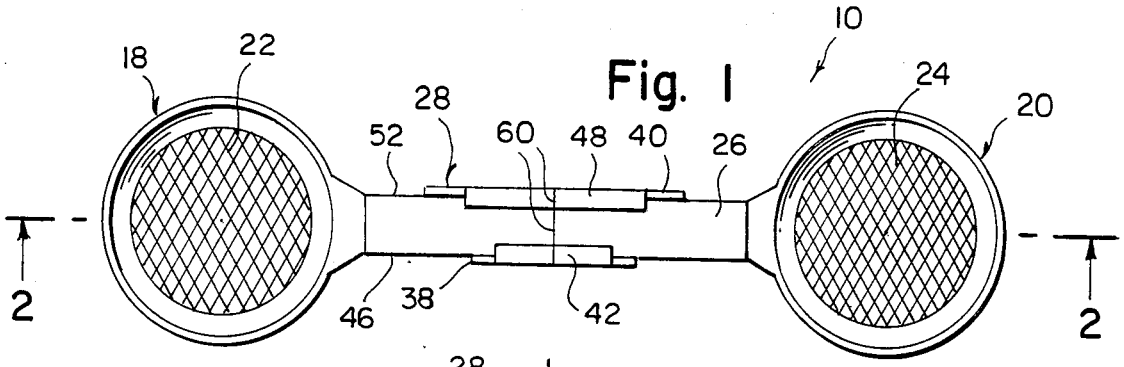
FIG. 1 is a top view of the invention.
Figure 2:
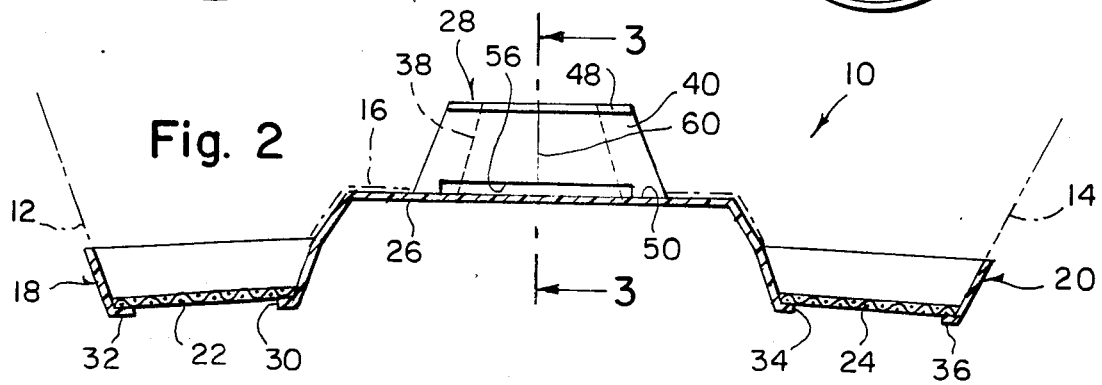
FIG. 2 is a cross sectional view taken along line 2—2 in FIG. 1.
Figure 3:
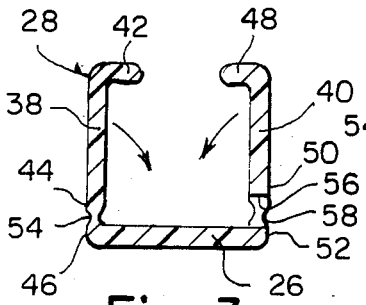
FIG. 3 is a cross sectional view taken along line 3—3 in FIG. 2.
Figure 4:
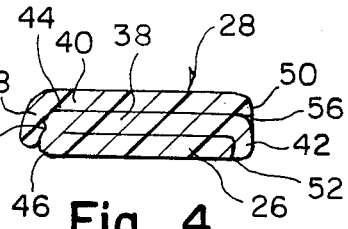
FIG. 4 is a cross sectional view similar to FIG. 3 showing the retainer arms folded down for storage.

Turning now descriptively to the drawings, in which similar reference characters denote similar elements throughout the several views, FIGS. 1 through 4 illustrates a conventional transmitter device 10 for protecting a speaker 12 and earpiece 14 on a telephone handset 16, shown in phantom lines, from germs and the like. The device 10 consists of a pair of receptacle 18, 20, a pair of filters 24, 22, a flat frame member 26 and a structure 28 for clamping the flat frame member 26 against bottom of the telephone handset 16.

The first receptacle 18 has an aperture 30 at bottom with a lip 32. The first receptacle is shaped to cover the speaker 12. The second receptacle 20 has an aperture 34 at bottom with a lip 36. The second receptacle is shaped to cover the earpiece 14. Filter 22 is insertable within and removable from the receptacle 18 and filter 24 is insertable within and removable from the receptacle 20. The filters 22, 24 will not interfere with normal functions of the telephone handset 16. The flat frame member 26 is secured between the receptacles 18, 20.

The structure 28 for clamping the flat frame member 26 against bottom of the telephone handset 16 consists of a pair of retaining arms 38, 40. First retaining arm 38 has an inwardly extending hook at one end 42 and other end 44 is secured perpendicular to side 46 of the flat frame member 26. Second retaining arm 40 has an inwardly extending hook at one end 48 and other end 50 is secured perpendicular to side 52 of the flat frame member 26. Both retaining arms 38, 40 can clamp around the telephone handset 16.

The first retaining arm 38 is narrower than the second retaining arm 40 and has a fold line 54 along its juncture with the flat frame member 26. The second retaining arm 40 has a longitudinal slot 56 and a fold line 58 along its juncture with the flat frame member 26. The first retaining arm 38 can fold down with its hook end 42 extending within the slot 56 of the second retaining arm 40 and the second retaining arm can fold down over the first retaining arm for storage (see FIG. 4).

A transverse fold line 60 is provided through center of the first retaining arm 38, the second retaining arm 40 and the flat frame member 26. After the retaining arms are folded down the device 10 can be folded in half for storage to fit into a purse or pocket for easy concealment.

Figure 6:
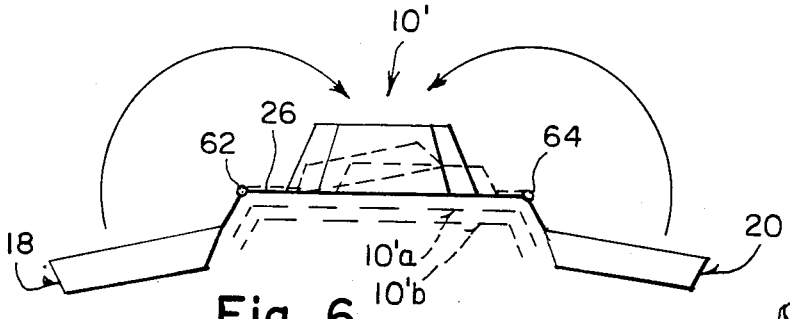
FIG. 6 is a diagrammatic side view of a second modification showing a folding system for stacking one device within the other.

In FIG. 6 a modified device 10' is shown. The flat frame member 26 contains a first transverse fold line 62 along the juncture with the first receptacle 18 and a second transverse fold line 64 along its juncture with the second receptacle 20. The first receptacle and the second receptacle can be folded upward over the flat frame member 26 for stacked storage with other devices **10'*a* and 10'*b*** shown in phantom lines.

Figure 5:
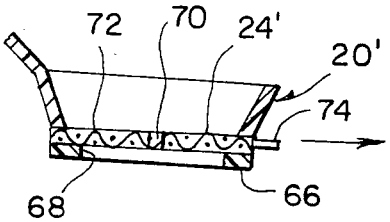
FIG. 5 is a partial cross sectional view of a first modification showing a filter that can be inserted laterally.

In FIG. 5 a modified receptacle 20' is shown and consists of a flat plate 66 that has an aperture 68 therethrough and at least two holding straps 70 (only one shown in drawing). Each strap 70 is mounted perpendicular from edge of the plate 66 to bottom 72, the receptacle 20' with the plate 66 spaced away from the bottom 72 of the receptacle.

The filter 24' can be inserted laterally between the plate 66 and the receptacle 20'. The filter 24' contains a tab 74 extending laterally from one side so that the tab can be held between two fingers of a person (not shown) for easy insertion between the plate and the receptacle. The other receptacle 18' and filter 22' (not shown) are fabricated in the same manner as the receptacle 20' and filter 24' described above.

Figure 7:
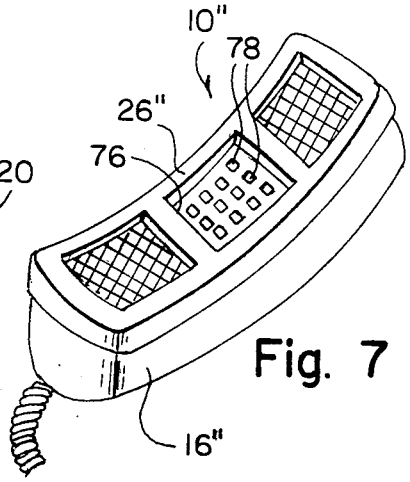
FIG. 7 is a perspective view of a third modification showing the device used on a trimline telephone handset.

Another modified device 10'' is shown in FIG. 7, the flat frame member 26'' has an opening 76 and is placed against a trimline telephone handset 16'' so that push button digits 78 are exposed to be used thereon.

Figure 8:
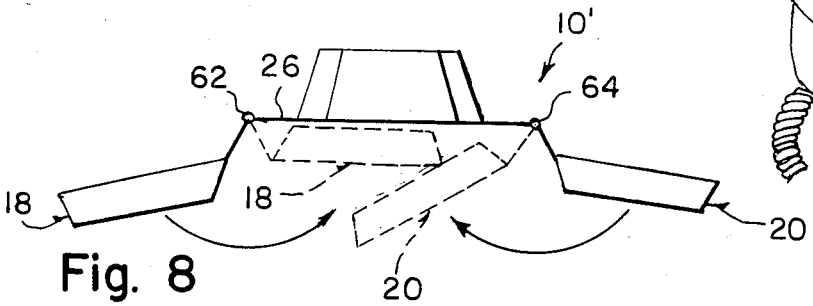
FIG. 8 is a diagrammatic side view of the second modification showing another way of using the folding system for stacking.

In FIG. 8 the modified device 10' is shown again. The flat frame member 26 contains the first transverse fold line 62 along the juncture with the first receptacle 18 and the second transverse fold line 64 along its juncture with the second receptacle 20. The first receptacle and the second receptacle can now be folded downard under the flat frame member 26 for storage as indicated by the arrows.

The device can be made in any shape, contour, dimension and material necessary to fill all shapes and sizes of telephone.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A device for protecting a speaker and earpiece on a telephone handset from germs and the like which comprises:

(a) a pair of receptacles, each said receptacle having a bottom with an aperture and a transverse surrounding lip, said receptacles shaped to receive snugly and cover the speaker and the earpiece of the telephone handset;

(b) a pair of filters, each said filter is insertable within and removable from each said receptacle, wherein said filters will not interfere with normal functions of the telephone handset;

(c) a flat frame member secured between said receptacles; and (d) means for clamping said flat frame member against the inner side of the telephone handset handle portion, wherein said means for clamping said frame member against said inner side comprises a pair of retaining arms, each said retaining arm having an inwardly extending hook at one end and the other end secured to said flat frame member so that both said retaining arms clamp snugly around the telephone handset wherein said first retaining arm beig narrower than said second retaining arm and having a fold line, with said flat frame member and said second retaining arm having a longitudinal slot and fold line with said flat frame member so that said first retaining arms can fold down with its hook end extending within the slot of said seond retaining arm and said second retaining arm can fold down over and clamp on said first retaining arm for storage and stacking purposes.

2. A device for protecting a speaker and earpiece on a telephone handset from germs and the like as recited in claim 1, wherein said flat frame member contains a first transverse fold line with said first receptacle and a second transverse fold line with said second receptacle so that said first receptacle and said second receptacle can be folded upward over said flat frame member for stacked storage.

3. A device as in claim 2, wherein said fold lines provide for folding downward.

4. A device for protecting a speaker and earpiece on a telephone handset from germs and the like as recited in claim 1, wherein said receptacles have lateral apertures to receive a filter therethrough said filter each having an external tab extending laterally from one side so that said tab can be held between two fingers for easy insertion and removal from said receptacle through said lateral aperture.

* * * * *